United States Patent [19]

Audeh

[11] 4,435,270

[45] Mar. 6, 1984

[54] RE-REFINING LUBRICATING OIL IN A BED OF OIL SHALE

[75] Inventor: Costandi A. Audeh, Princeton, N.J.

[73] Assignee: Mobil Oil Corporation, New York, N.Y.

[21] Appl. No.: 515,717

[22] Filed: Jul. 20, 1983

[51] Int. Cl.[3] ..... C10B 53/06

[52] U.S. Cl. ..... 208/11 R; 208/179; 208/182

[58] Field of Search ..... 208/179, 182, 299, 307, 208/11 R, 11 LE

[56] References Cited

U.S. PATENT DOCUMENTS 4,090,953 5/1978 Bridger et al. ..... 208/299

4,238,315 12/1980 Patzer ..... 208/11 LE

*Primary Examiner*—Delbert E. Gantz

*Assistant Examiner*—Anthony McFarlane

*Attorney, Agent, or Firm*—Charles J. Speciale; Michael G. Gilman; Alexander J. McKillop

[57] ABSTRACT

A method of reclaiming usable stock from used lubricating oil includes passing the used oil through a bed of oil shale containing kerogen. The shale removes impurities from the oil. The shale is then heated to convert the kerogens to shale oil in the presence of hydrogen donor compounds contained in the lubricating oil remaining in the shale. These enhance hydrogen transfer during shale oil production.

12 Claims, 1 Drawing Figure

RE-REFINING LUBRICATING OIL IN A BED OF OIL SHALE

BACKGROUND OF THE INVENTION

This invention relates to the re-refining of lubricating oil and more particularly to passing the lubricating oil through a bed of oil shale to enhance the re-refining and the conversion of kerogens in the shale oil.

The increasing concern for conservation of petroleum reserves and the best use of products derived from them has engendered renewed interest in re-refining lubricating oils. The re-refining of used lubricating oils has also been practiced to reduce the ecological impact of disposal. Used lubricating oils are contaminated with water, debris from wear of metal parts and decomposition products of spent additives in the oil.

Removing these contaminants to produce a reusable crude stock is desirable. Lubricating oils are manufactured from special crude oils. Such crude oils are not very common and for a crude oil to be designated as a "lube crude", rigorous standards of yield versus treat conditions have to be met. A lube oil base stock has to meet other rigorous standards before it is considered suitable for an economically and commercially viable application in lube formulations. The recovery of these lubricating base stocks is desirable.

As is known, additives and combinations of additives are mixed with base stock to meet operational requirements of viscosity index, oxidation stability, demulsification behavior, and so on. In service, the additives which are usually the minor component of the total mixture, become spent and the lubricating oil loses the properties required for that particular service. However, the major portion of the base stock remains unchanged and it can be recovered by removing the metal debris and other contaminants.

"NEW RE-REFINING TECHNOLOGIES OF THE WESTERN WORLD" M. L. Whisman, Manual of the Amer. Soc. of Lubrication Engineers, Vol. 35, 5, pp. 249–253, summarizes the prior art techniques of re-refining lubricating oil. This article refes to U.S. Pat. Nos. 3,773,658, 3,919,075, 3,879,282, 3,930,988, and 4,073,719 as showing typical processes for re-refining lubricating oils. In general, the prior art techniques produce a usable base stock and sludge which must be disposed of.

In a separate technology, useful hydrocarbons are recovered from oil shale. U.S. Pat. No. 3,574,087, for example, shows oil shale being fed to a retort for the conversion of kerogens to hydrocarbons. This conversion is a difficult procedure which can be enhanced by doing it in the presence of hydrogen donor compounds.

RELATED APPLICATIONS

My co-pending application Ser. No. 8/288,617, filed July 30, 1981, "Method for Processing Vacuum Tower Bottoms", describes mixing oil shale fines with heavy vacuum tower bottoms to enhance hydrocarbon recovery.

SUMMARY OF THE INVENTION

In accordance with the present invention, used lubricating oil is passed through a bed of oil shale which removes water and contaminants from the lubricating oil. The treated oil is collected. Thereafter, the oil shale from the bed is retorted to convert kerogens to shale oil in the presence of hydrogen donor compounds contained in the lubricating oil remaining in the shale. These compounds, such as hydroaromatics, enhance hydrogen transfer during shale oil production, thereby aiding the conversion of kerogen to shale oil.

In practicing the invention, the bed of oil shale is heated to remove absorbed water and the used lubricating oil is heated to reduce its viscosity. The lubricating oil is pumped upflow through the bed of oil shale. After it has passed through the shale, the treated oil is collected and distilled with the residual of the distillation being returned to the bed of oil shale. After retorting, the residual carbon on the spent shale is gasified or burnt as fuel.

The practice of the invention results in an economical, efficient conversion of both lubricating oil and oil shale to useful products.

The foregoing and other objects, features and advantages of the invention will be better understood from the following more detailed description and appended claims.

SHORT DESCRIPTION OF THE DRAWING

The drawing depicts the reclamation of usable stock from used lubricating oil and the conversion of oil shale to hydrocarbons in accordance with the present invention.

DESCRIPTION OF THE PREFERRED EMBODIMENT

Figure 1:
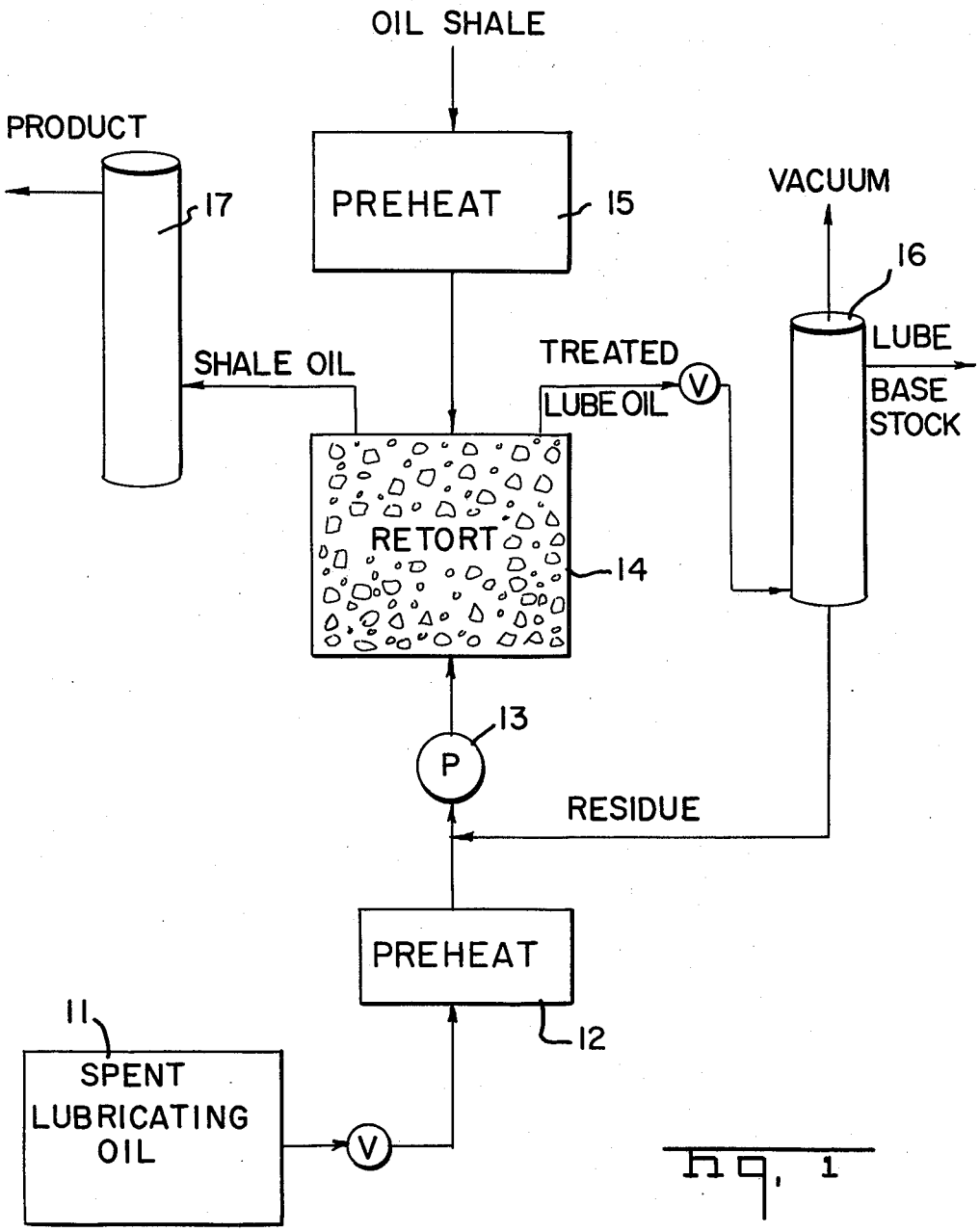

Referring to the FIGURE, a reservoir of spent lubricating oil is shown at 11. This lubricating oil is preheated by heater 12 to 50°–60° C. so as to reduce its viscosity. Pump 13 pumps the used lubricating oil upflow through the bed of oil shale contained in retort 14. Pumping the oil upflow has the advantage of providing bette control of the residue time.

Oil shale is preheated by heater 15 to about 180° C. to remove physically absorbed water. Oil shale has the ability to absorb water even before dehydration. However, dehydrated shale is more efficient and has a greater capacity for water absorption. Used lubricating oil is pumped by pump 13 through the shale bed in quantities that depend upon the water content of the oil so that the capacity of the dehydrated shale for water removal is not exceeded. In addition to water removal, solid debris including metals, is removed by passage through the bed of shale.

The treated lube oil is collected and sent to a distillation column 16 where only hydrocarbons are collected overhead. This produces usable lubricating base stock. In accordance with the preferred practice of the invention, all of the lubricating oil being processed at a given time is of the same type. For example, only used automotive lubricating oil is processed at a given time. Then, only used industrial lubricating oil of a particular type is processed, and so on. If this is done, the lube base stock coming out of distillation column 16 will all come out at the same temperature range. This optimizes distillation.

Residual that is not distilled in column 16 and which contains additive decomposition products not previously removed, is returned to the bed of oil shale through pump 13.

After the spent lubricating oil has been treated as described above, retorting of the now oil-saturated shale proceeds. By adjusting appropriate valves and applying heat to retort 14 the conversion of kerogen contained in the shale proceeds. Products from the retort include shale oil and decomposition products generated from the used lubricating and from the residual oil.

Since the kerogen, which contains the organic carbon of the oil shale, is converted into shale oil in the presence of hydrocarbons that contain hydroaromatics, hydrogen transfer during retorting enhances shale oil production. This is especially beneficial for certain types of shale which are hydrogen deficient. While the presence of hydroaromatics in the lubricating oil is one example of beneficial hydrogen donor compounds, other such compounds exist. For example, some nitrogen compounds are hydrogen donors and will enhance the conversion of kerogen to hydrocarbons.

Shale oil produced from the retorting is supplied to the distillation column 17 where it is distilled. Further upgrading may be applied to produce usable hydrocarbon products.

The spent shale is disposed of by using the residual carbon as a fuel or by gasification.

EXAMPLES

A 200 gm sample of 28/35 mesh shale was divided into the equal portions. The first portion of 100 gm was used in Example 1 and the second 100 gm were used in Example 2.

EXAMPLE 1

(Step A) A 100 gm bed of shale loaded in a retort was dehydrated in the presence of an inert stripping gas at 180° C. The dehydrated shale was then cooled to 70° C. At that temperature, 350 cc of used automotive oil, collected from the crank case of an automobile engine, were pumped over the dehydrated shale. Treated used oil, 330 cc was collected.

(Step B) In the retorting cycle, shale andoil on the bed of shale were heated at a heating rate of about 12° C./min until the temperature of the shale in the retort reached 500° C. The temperature was held at 500° C. for 30 min. The volume of oil produced during the retorting cycle was 25 cc.

The second 100 gm sample of shale prepared for these examples was retorted in the same retort used for the first sample by heating the sample also as described above. The volume of oil produced was 5 cc. In the absence of the automotive oil, that is without the treatment, the voluume of oil produced upon retorting the same shale was approximately 20 cc less than with the treatment.

EXAMPLE 2

Waste oil as collected from the crank case of the automobile engine contained 1.0% water and sediment as determined by ASTM D96 and 0.5% water as determined by ASTM D95.

After treatment of the waste oil, as described in Example 1, Step A, the treated oil contained <0.5% by ASTM D96 and <0.1% as determined by ASTM D95.

While the invention has been described in terms of first passing the lube oil through the shale, and thereafter retorting the shale, these steps can be carried out concurrently in a counter current process by careful control of process conditions. Various other modifications are within the true spirit and scope of the invention. The appended claims are, therefore, intended to cover all such modifications.

What is claimed is :

1. A method of reclaiming usable stock from used lubricating oil comprising:

passing said used lubricating oil through a bed of oil shale containing kerogen;

collecting the treated oil passed through said bed; and heating the oil shale in said bed to convert said kerogens to shale oil in the presence of hydrogen donor compounds contained in the lubricating oil remaining in said shale and which enhance hydrogen transfer during shale oil production.

2. The method recited in claim 1 wherein said hydrogen donor compounds are hydroaromatics.

3. The method recited in claim 1 further comprising: heating said bed of oil shale prior to passing lubricating oil through it to remove absorbed water.

4. The method recited in claim 1 further comprising: heating said used lubricating oil prior to passing it through said bed to reduce its viscosity.

5. The method recited in claim 1 wherein the step of passing includes pumping said lubricating oil upflow through the bed of oil shale.

6. The method recited in claim 1 further comprising: distilling the collected treated oil; and returning the residual of the distillation to said bed of oil shale.

7. The method recited in claim 6 wherein said used lubricating oil is uniformly of the same type and wherein the step of distilling is carried out to bring off lube base stock at a given temperature range.

8. The method recited in claim 1 further comprising: distilling and upgrading the shale oil produced from heating the oil shale.

9. The method recited in claim 1 wherein the step of heating the oil shale includes retorting.

10. The method recited in claim 1 further comprising: gasifying the spent shale after it has been heated.

11. The method recited in claim 1 further comprising: burning as fuel the spent shale after it has been heated.

12. The method recited in claim 1 wherein the step of heating the oil shale is carried out after said shale is saturated by passing used lubricating oil through it.

* * * * *